US006298203B1

(12) United States Patent
Hashimoto et al.

(10) Patent No.: US 6,298,203 B1
(45) Date of Patent: Oct. 2, 2001

(54) DEVELOPING APPARATUS FEATURING SUPPRESSED DEVIATION OF A POSITIONAL RELATIONSHIP BETWEEN A DEVELOPER BEARING MEMBER AND A DEVELOPER REGULATOR MEMBER AND METHOD FOR ASSEMBLING THE APPARATUS

(75) Inventors: Kouji Hashimoto, Shizuoka-ken; Akiyoshi Fujita, Numazu, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/382,387

(22) Filed: Aug. 25, 1999

(30) Foreign Application Priority Data

Aug. 31, 1998 (JP) ..... 10-262429

(51) Int. Cl.[7] ..... G03G 15/08
(52) U.S. Cl. ..... 399/119; 399/274; 399/284
(58) Field of Search ..... 399/119, 274, 399/284

(56) References Cited

U.S. PATENT DOCUMENTS

| | | | | |
|---|---|---|---|---|
| 4,755,847 | * | 7/1988 | Matsushiro et al. | 399/284 |
| 5,089,849 | * | 2/1992 | Hiraoka | 399/119 |
| 5,412,458 | * | 5/1995 | Kamaji et al. | 399/284 |
| 6,016,408 | * | 1/2000 | Hashimoto et al. | 399/119 |
| 6,047,150 | * | 4/2000 | Kanno et al. | 399/119 |
| 6,101,352 | * | 8/2000 | Hashimoto et al. | 399/119 |

FOREIGN PATENT DOCUMENTS

| | | | |
|---|---|---|---|
| 5-61327 | * | 3/1993 | (JP) . |
| 20-122415 | * | 4/2000 | (JP) . |

* cited by examiner

*Primary Examiner*—Quana M. Grainger
(74) *Attorney, Agent, or Firm*—Fitzpatrick, Cella, Harper & Scinto

(57) ABSTRACT

A positioning member has a position, which can be adjusted with respect to a developing container by shifting the positioning member with respect to the developing container, while holding a regulating member by the positioning member.

22 Claims, 7 Drawing Sheets

DEVELOPING APPARATUS FEATURING SUPPRESSED DEVIATION OF A POSITIONAL RELATIONSHIP BETWEEN A DEVELOPER BEARING MEMBER AND A DEVELOPER REGULATOR MEMBER AND METHOD FOR ASSEMBLING THE APPARATUS

BACKGROUND OF THE INVENTION

1. Field of the Invention

The present invention relates to a developing apparatus which can be used with a forming apparatus such as an electrophotographic copying machine, an electrophotographic printer and the like.

2. Related Background Art

In image forming apparatuses of electrophotographic type or electrostatic type, an electrostatic latent image formed on an image bearing body such as an electrophotographic photosensitive body or an electrostatic recording dielectric body is visualized by a developing apparatus as a toner image.

As an example of such developing apparatuses, various dry one-component developing apparatuses have been proposed and put to a practical use. However, in all of such developing apparatuses, it is difficult to form a thin toner (one-component developer) layer on a developer bearing body.

Nowadays, since improvement in resolution and clearness of an image have been requested, development regarding method and apparatus for forming a thin toner layer is inevitable and some attempts have been proposed.

For example, as disclosed in Japanese Patent Application Laid-open No. 54-43038, an elastic blade (regulating member) made of metal or rubber abuts against a developing sleeve (developer bearing body) so that, by passing toner through an abutment area between the elastic blade and the developing sleeve to regulate the toner, a thin toner layer is formed on the developing sleeve and adequate triboelectricity is applied to the toner by friction generated in the abutment area.

In this case, when nonmagnetic toner is regulated by the elastic blade, a toner supplying member for supplying the toner onto the developing sleeve must be provided additionally. The reason is that, although magnetic toner can be supplied onto the developing sleeve by a force of a magnet disposed within the developing sleeve, the nonmagnetic toner cannot be supplied by such a magnetic force.

Now, an example of a conventional color laser printer as a conventional multicolor electrophotographic image forming apparatus will be described with reference to FIG. 6.

Within a main body of an image forming apparatus, there are disposed an image bearing body unit 101, a laser scanner portion 105, a developing unit 106 of rotary type, a transfer unit 107, a sheet feeding unit 108 and a fixing device 109 and the like.

The image bearing body unit 101 includes an image bearing body (electrophotographic photosensitive drum) 102 rotated in an counter-clockwise direction shown by the arrow, a charging device 103 and a cleaning device 104 and constitutes a process cartridge detachably attachable to the main body of the image forming apparatus.

The developing unit 106 includes four developing devices 106Y, 106M, 106C, 106B containing four color (yellow, magenta, cyan and black) toners. The four color developing devices are rotatably mounted on a rotary 106*b* rotated in a clockwise direction around a shaft 106*a* . The shaft 106*a* is provided with a revolution gear around which rotation gears are meshed, so that, in synchronism with the movement of the rotation gears, the developing devices 106Y, 106M, 106C, 106B are rotated, thereby maintaining the postures of the developing devices constant.

The developing devices 106Y, 106M, 106C, 106B are constituted as a developing cartridge detachably attachable to the rotary 106*b*.

The transfer unit 107 mainly includes a transfer drum 107*a* rotated in a clockwise direction shown by the arrow, so that a transfer material P fed from the sheet feeding unit 108 can be wound around the transfer drum 107*a* and be conveyed by the transfer drum.

The sheet feeding unit 108 includes a sheet feeding cassette 108*a* disposed at a lower part of the main body of the image forming apparatus, a sheet feeding roller (pick-up roller) 108*b* for feeding out the transfer materials P from the sheet feeding cassette, and a sheet path 108*c* including a one sheet separation and feed roller, a turn roller and registration rollers, so that the transfer material P is fed to the transfer drum 107*a* of the transfer unit 107 at a predetermined control timing.

When the rotating image bearing body 102 of the image bearing body unit 101 is subjected to uniform charging treatment effected by the charging device 103 with a predetermined polarity and potential and laser scan exposure L (corresponding to predetermined image information) effected by the laser scanner portion 105, an electrostatic latent image corresponding to the predetermined image information is formed on the peripheral surface of image bearing body.

The electrostatic latent image is developed as a toner image by a predetermined developing device of the developing unit 106. In image formation, among the developing devices 106Y, 106M, 106C, 106B of the developing unit 106, the developing device corresponding to the latent image is stopped at a position opposed to the image bearing body 102, and the developing device is pressed against the image bearing body 102 by a pressurizing mechanism so that a developing sleeve 106S is positioned to be opposed to the surface of the image bearing body 102 with a small gap therebetween. In the development, bias is applied to the developing sleeve 106S and the developing sleeve is rotated, thereby developing the latent image formed on the image bearing body 102 as a toner image. The toner image is transferred onto the transfer material P wound around the peripheral surface of the transfer drum 107*a*.

The cleaning device 104 serves to remove residual toner from the surface of the image bearing body after the transferring operation.

In case of a full-color image, four color (yellow, magenta, cyan and black) toner images successively formed on the image bearing body 102 are successively transferred onto the same transfer material P wound around the peripheral surface of the transfer drum 107*a*.

The transfer material P to which the toner images were transferred is separated from the surface of the transfer drum 107*a* and then is introduced into the fixing device 109, where the toner images are melted and mixed by receiving permanent fixing to form a full-color toner image. Thereafter, the transfer material is discharged out of the image forming apparatus.

FIG. 7 is an enlarged schematic sectional view of the developing apparatus (developing cartridge). The developing devices 106 (Y, M, C, B) have the same constructions and each has a developing container 91 containing nonmagnetic toner (one-component developer) T, a rotating developing sleeve (developer bearing body) 92 disposed at an opening portion of the developing container, an elastic regulating blade 93 abutting against the developing sleeve with the interposition of the developer, an elastic roller (developer supplying member for supplying the developer to the developing sleeve) 94, and a toner feed mechanism 95 and the like.

More specifically, in this conventional developing apparatus, within the developing container 91 containing the nonmagnetic toner (one-component developer) T, there is provided the elastic roller 94 using foam material such as polyurethane foam or sponge or a fur brush which abuts against the developing sleeve 92 at a position upstream of the elastic regulating blade 93 in a rotational direction of the developing sleeve 92, so that, by rotating the elastic roller 94 in a direction shown by the arrow F, the toner T is supplied onto the developing sleeve 92.

The elastic regulating blade 93 comprises an elastic blade portion and a support metal plate for supporting the blade portion, and the support metal plate is pinched between a holding metal plate 68 of the developing container 91 and a pressing metal plate 69. The holding metal plate 68, elastic regulating blade 93 and pressing metal plate 69 are positioned by a positioning boss 27*b* integral with the developing container 91.

The toner T supplied to the developing sleeve 92 by the rotation of the elastic roller 94 is sent to an abutment area between the elastic regulating blade 93 and the developing sleeve 92 to form a thin layer as the developing sleeve 92 is rotated, or preparation or development of the electrostatic latent image formed on the photosensitive body (image bearing body) 102.

Residual toner remaining on the developing sleeve 92 (which was not consumed) is brought to an abutment area between the developing sleeve 92 and the elastic roller 94 by further rotation of the developing sleeve 92, where the residual toner is scraped by the elastic roller 94, and new toner is supplied onto the developing sleeve 92 by the rotation of the elastic roller 94. This operation is repeated.

Further, in this case, when metallic material is used to form the developing sleeve 92, the regulating blade 93 formed from a thin metal plate is not preferable from a viewpoint of wear of the developing sleeve 92, and, in order to obtain a good thin toner layer, rubber material such as urethane or silicone must be used.

With this arrangement, a thin layer of the nonmagnetic toner T can be effectively formed on the developing sleeve 92 effectively.

However, when toner including spherical and smooth particles (toner having shape factor SF-1 of 100 to 180 and shape factor SF-2 of 100 to 140) obtained by recent further improvement is utilized, if the conventional developing apparatus is used, depending upon the positional relationship between the elastic regulating blade 93 and the developing sleeve 92, passing-through of the toner may occur and/or developing ability may be worsened.

To avoid this problem, a tolerance of positioning of the elastic regulating blade with respect to the main body of the image forming apparatus must be severely selected to eliminate positional deviation. Thus, costs of the elastic regulating blade 93 and the developing container 91 and elastic regulating blade holding metal plate 68 to which the elastic regulating blade is attached are increased greatly, thereby making the entire developing apparatus more expensive.

Further, to solve such a problem, although it is considered that, after attachment, the elastic regulating blade 93 is adjusted to improve the positioning accuracy, in effect, since the support metal plate for the elastic regulating blade 93 is formed from a thin metal sheet, when the support metal plate is moved during the adjustment, the metal plate will be deformed, thereby making the adjustment impossible.

SUMMARY OF THE INVENTION

An object of the present invention is to provide a developing apparatus and a method for assembling such a developing apparatus, in which deviation in positional relationship between an developer bearing body and a regulating member for regulating a thickness of a layer of developer to be formed on the developer bearing body can be suppressed with low cost.

Another object of the present invention is to provide a developing apparatus and a method for assembling such a developing apparatus, in which a positional relationship between a developer bearing body and a regulating member can easily be adjusted.

The other object of the present invention is to provide a developing apparatus and a method for assembling such a developing apparatus, in which a positioning member can be shifted with respect to a developing container together with a regulating member.

DESCRIPTION OF THE PREFERRED EMBODIMENTS

Figure 1:
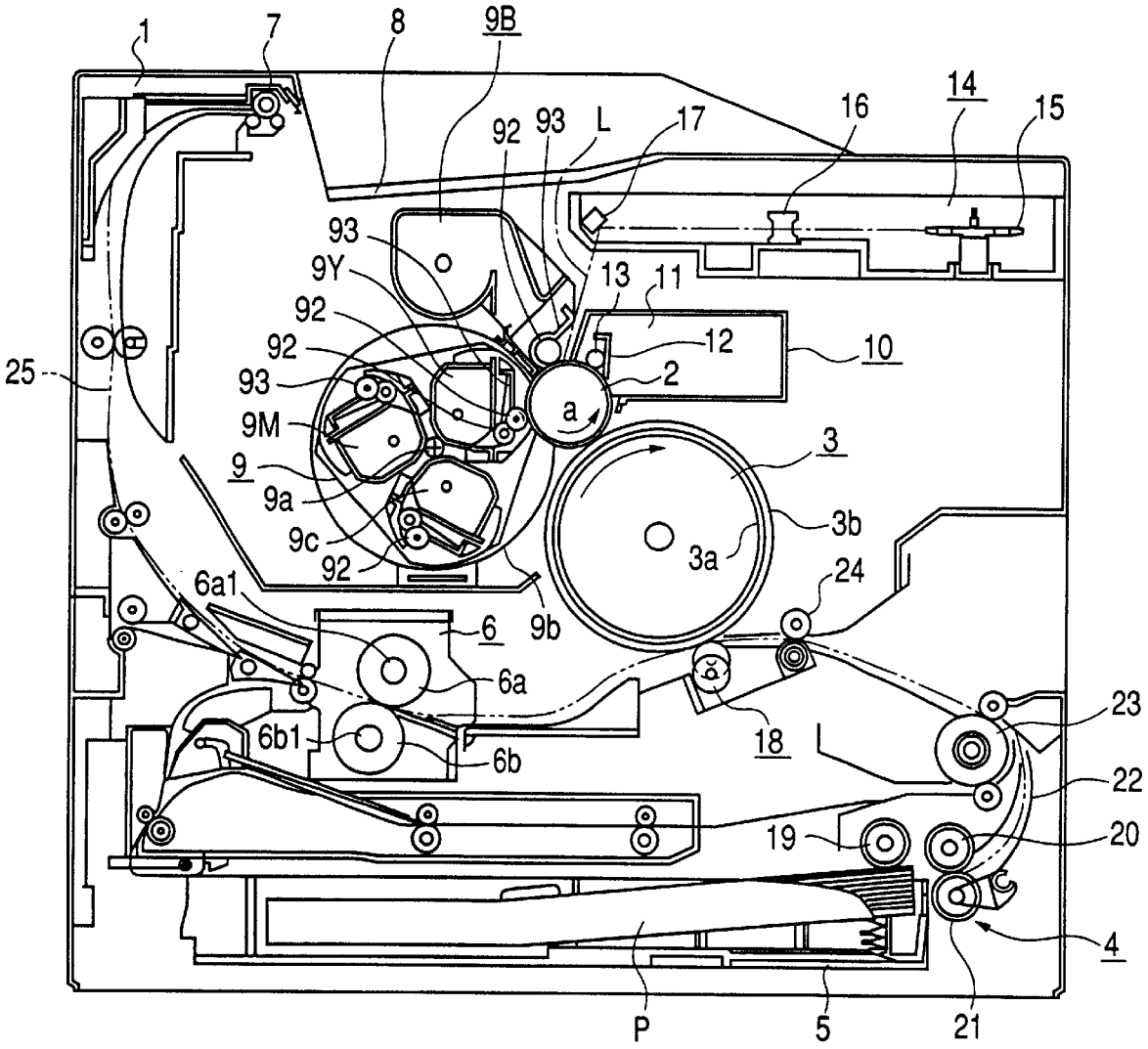
FIG. 1 is a schematic constructural view of an image forming apparatus according to an embodiment of the present invention.

FIG. 1 is a schematic constructural view of a developing apparatus according to the present invention, and an image forming apparatus according to an embodiment of the present invention which uses such a developing apparatus. In the illustrated embodiment, the image forming apparatus is embodied as a color laser beam printer using a transfer electrophotographic process.

(1) Schematic entire construction of image forming apparatus

Within a main body 1 of the image forming apparatus, there are disposed a drum unit 10, a laser scanner portion 14, a black developing device 9B, a developing unit 9 of rotary type, an intermediate transfer body 3 of rotation drum type, a sheet feeding unit 4, a transfer roller 18 and a fixing device 6.

(a) Drum unit 10

The drum unit 10 includes a drum-shaped electrophotographic photosensitive body (image bearing body) 2, a primary charging means 13 and a cleaning container 11 and the like, and is formed integrally with the image bearing body 2 and the cleaning container 11 also acting as a holder for the image bearing body 2 and containing residual matter removed from the surface of the image bearing body 2.

The drum unit 10 is detachably supported with respect to the main body 1 of the image forming apparatus and is constituted as a process cartridge, which can easily be exchanged as a service life of the image bearing body 2 is expired.

In the illustrated embodiment, the image bearing body 2 is constituted by an aluminum cylinder having a diameter of about 62 mm, and an organic photoelectric layer coated on the cylinder and is rotatably supported with respect to the cleaning container 11 also acting as the holder for the image bearing body 2. In the vicinity of the periphery of the image bearing body 2, there are disposed a cleaner blade 12 as a cleaning means for removing residual matters from the surface of the image bearing body 2, and the primary charging means 13 for charging the surface of the image bearing body 2.

Further, the image bearing body 2 is rotated in an counterclockwise direction shown by the arrow "a" at a predetermined constant speed in response to image formation by applying a driving force from a drive motor (not shown) to a rear end (opposite to an end shown in FIG. 1) of the image bearing body 2.

The primary charging means 13 is of contact charging type and comprises a conductive roller. By applying voltage to the primary charging means 13 urged against the image bearing body 2, the surface of the image bearing body 2 is uniformly charged.

(b) Laser scanner portion 14

The surface of the image bearing body 2 uniformly charged by the primary charging means 13 is subjected to laser scanning exposure L from the laser scanner portion 14, thereby forming an electrostatic latent image on the surface of the image bearing body 2.

That is to say, when an image signal is given to a laser diode of the laser scanner portion 14, the laser diode emits image light (laser beam) corresponding to the image signal to a polygon mirror 15. The polygon mirror 15 is rotated at a high speed by a scanner motor. The image light reflected by the polygon mirror 15 selectively exposes the surface of the image bearing body 2 (rotated at the constant speed) through a focusing lens 16 and a reflection mirror 17, with the result that the electrostatic latent image is formed on the surface of the image bearing body 2.

(c) Black developing device 9B and developing unit 9 of rotary type

The black developing device 9B and the rotatable developing unit 9 of rotary type having three color (yellow, magenta and cyan) developing devices 9Y, 9M, 9C are disposed in the vicinity of the image bearing body 2, so that the latent image formed on the image bearing body 2 is developed as a toner image by the developing devices.

The black developing device 9B contains black toner and is fixed with respect to the main body 1 of the image forming apparatus in the vicinity of the image bearing body 2 and is constituted as a developing cartridge which can be detachably attachable to the main body of the image forming apparatus.

At a position opposed to the image bearing body 2, a developing sleeve 92 as a developer bearing body (developing rotary member) for supplying black toner (developer) to the image bearing body 2 is opposed to the image bearing body 2 with a small gap (about 300 $\mu$m) therebetween so that the electrostatic latent image on the image bearing body 2 can be developed as a visualized image.

On the other hand, the three color developing devices 9Y, 9M, 9C of the developing unit 9 of rotary type contain toners each having an amount corresponding to 7000 sheets (A4 size; 5% print) and are supported by a rotary 9*c* rotated around a shaft 9*a* . Each of the color developing devices 9Y, 9M, 9C is constituted as a developing cartridge which can detachably attached to the rotary 9*b*.

In the image formation, the color developing devices 9Y, 9M, 9C supported by the rotary 9*b* are rotated around the shaft 9*a* so as to position a selected color developing device 9Y, 9M or 9C in a confronting relationship to the image bearing body 2, with the result that a developing sleeve 92 as a developer bearing body (developing rotary member) for supplying yellow, magenta or cyan toner (developer) to the image bearing body 2 is opposed to the image bearing body 2 with a small gap (about 300 $\mu$m) therebetween. Thereafter, the electrostatic latent image on the image bearing body 2 is visualized by color toner.

During the color image formation, whenever the intermediate transfer body 3 is rotated by one revolution, the rotary 9*b* is rotated so that the developing processes are successively effected by the yellow developing device 9Y, magenta developing device 9M, cyan developing device 9C and black developing device 9B, respectively.

Figure 2:
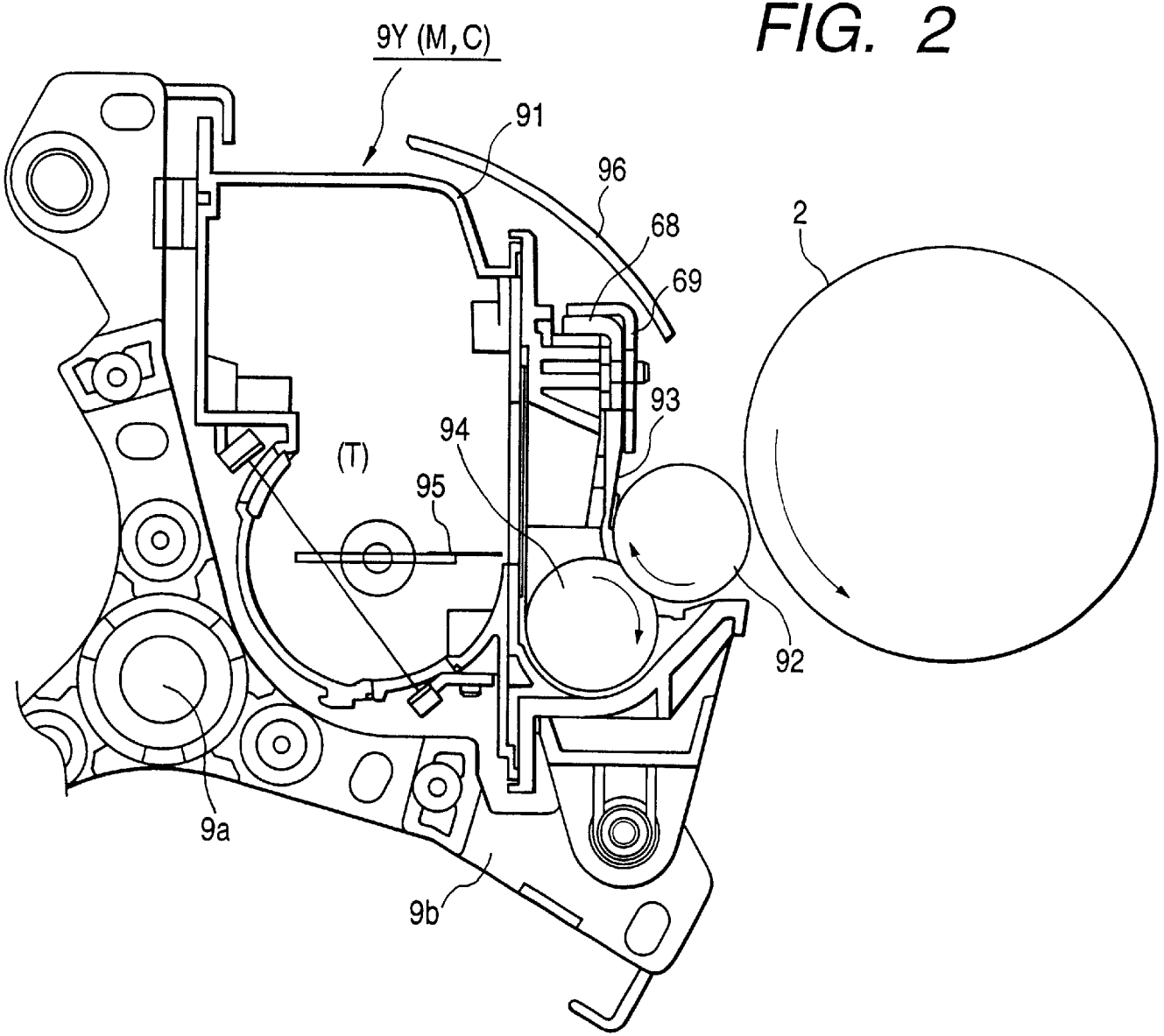
FIG. 2 is a partial enlarged view showing a developing apparatus and therearound.

FIG. 1 shows a condition that the yellow developing device 9Y is positioned in a confronting relationship to the image bearing body 2 and is stopped there. FIG. 2 is an enlarged view showing the yellow developing device 9Y.

The color developing devices 9Y, 9M, 9C have the same construction and each comprises a developing container 91 containing nonmagnetic toner (one-component developer) T, a rotatable developing sleeve (developer bearing body) 92 disposed in an opening portion of the developing container, an elastic regulating blade 93 urged against the developing sleeve with the interposition of the developer, an elastic roller (developer supplying member) 94 for supplying the developer to the developing sleeve, and a toner feeding mechanism 95. The regulating blade 93 serves to regulate a thickness of a toner layer borne on the developing sleeve. The regulating blade 93 includes an elastic blade portion, and a support metal plate integrally supporting the blade portion.

In the yellow developing device 9Y, the toner T in the developing container 91 for containing the developer is fed to the elastic roller 94 (supply rotary member for supplying the toner to the surface of the developing sleeve 92) by the feed mechanism 95, and a thin toner layer is formed on the surface of the developing sleeve 92 rotated in a clockwise direction by the elastic roller 94 rotated in a clockwise direction and the elastic regulating blade 93 urged against the peripheral surface of the developing sleeve 92, and charges are applied to the toner (frictional charging). By applying developing bias to the developing sleeve 92 opposed to the image bearing body 2 on which the latent image was formed, the latent image is developed by the toner.

Regarding the magenta developing device 9M and the cyan developing device 9C, the elastic roller (supply rotary member) 94, developing sleeve (developer bearing body) 92 and elastic regulating blade 93 are operated in the same manner as those in the yellow developing device 9Y, thereby effecting development.

Further, when the developing device 9Y, 9M or 9C is rotated to the developing station, the developing sleeve 92 of the developing device 9Y, 9M or 9C is connected to a corresponding high voltage source and a corresponding drive means of the main body 1 of the image forming apparatus so that voltage is selectively applied to the developing sleeve and the developing sleeve is rotatingly driven.

A developing sleeve protecting member (developing cartridge shutter) 96 is held at a closed position where it covers and protects the developing sleeve 92 when the developing device 9Y, 9M or 9C is not mounted on the rotary and can be shifted to an open position (as shown in FIG. 2) where the developing sleeve 92 is exposed when the developing device is mounted to a mounting portion of the rotary 9*b*.

An attachment structure for the elastic regulating blade 93 which is one of the features of the present invention will be described later (in item (2)).

(d) Intermediate transfer body 3

During the color image formation, the intermediate transfer body 3 is rotated in a clockwise direction (FIG. 1) in synchronous with an outer peripheral speed of the image bearing body 2 in order to receive four toner images (yellow, magenta, cyan and black toner images) visualized on the image bearing body 2 by the developing devices 9Y, 9M, 9C, 9B in a superimposed fashion. The intermediate transfer body 3 to which the toner images were transferred in the superimposed fashion cooperates with a transfer roller 18 (to which voltage was applied) to pinch (therebetween) and convey a transfer material P fed from the sheet feeding unit 4; meanwhile, the color toner images on the intermediate transfer body 3 are transferred onto the transfer material P collectively.

In the illustrated embodiment, the intermediate transfer body 3 is constituted by an aluminum cylinder 3*a* having a diameter of 186 mm, and an elastic layer 3*b* made of middle-resistance sponge or middle-resistance rubber and coated on the cylinder. The intermediate transfer body 3 is rotatably supported and is rotated when a gear (not shown) integral with the intermediate transfer body receives a driving force.

The cleaning means 12 for the image bearing body 2 serves to remove or clean transfer-residual toner remaining on the image bearing body 2 after the toner images visualized on the image bearing body 2 by the developing devices 9Y, 9M, 9C, 9B were transferred to the intermediate transfer body 3, and the removed toner (waste toner) is collected in the cleaning container 11. An amount of the waste toner collected in the cleaning container 11 is selected so that the cleaning container 11 is not filled with the waste toner before a service life of the image bearing body 2 is expired, and, accordingly, the cleaning container 11 is discarded at the same time when the image bearing body 2 is exchanged due to expiration of its service life.

(e) Sheet feeding unit 4

The sheet feeding unit 4 serves to feed the transfer material P to a transfer station between the intermediate transfer body 3 and the transfer roller 18 and comprises a convey means including a sheet feeding cassette 5 containing a plurality of transfer materials P, a pick-up roller 19, a feed roller 20, a retard roller 21 for preventing double-feeding, a feed guide 22, a convey roller 23, and registration rollers 24.

In the image formation, the pick-up roller 19 is rotated in synchronism with the image forming operation to feed out the transfer materials P from the sheet feeding cassette 5, and the feed roller 20 cooperates with the retard roller 21 to separate the transfer materials one-by-one, and the separated transfer material is guided by the feed guide 22 to reach the registration rollers 24 through the convey roller 23.

During the image formation, the registration rollers 24 effect a nonrotation operation for stopping and waiting the transfer material P and a rotation operation for conveying the transfer material P to the transfer station between the intermediate transfer body 3 and the transfer roller 18 in accordance with a predetermined sequence, thereby aligning the images on the intermediate transfer body 3 with the transfer material P in the subsequent transferring process.

(f) Transfer roller 18

The transfer station includes the rockable transfer roller 18. The transfer roller 18 is constituted by a metal shaft and a middle-resistance foam elastic body wound around the metal shaft and can be rotated and be rocked in an up-and-down direction in FIG. 1.

While the four color toner images are being formed on the intermediate transfer body 3, i.e., while the intermediate transfer body 3 is being rotated by several revolutions, the transfer roller 18 is retarded to a lower position (where it is spaced apart from the intermediate transfer body 3) not to distort the images. After the four color toner images were formed on the intermediate transfer body 3, the transfer roller 18 is urged against the intermediate transfer body 3 with the interposition of the transfer material P with predetermined pressure by means of a cam member (not shown) in synchronism with the timing for transferring the color toner images onto the transfer material P. In this case, at the same time, bias is applied to the transfer roller 18, with the result that the toner images formed on the intermediate transfer body 3 are transferred onto the transfer material P.

Since the intermediate transfer body 3 and the transfer roller 18 are driven independently, the transfer material P pinched therebetween is subjected to the transferring process and, at the same time, is conveyed to the left in FIG. 1 at a predetermined speed to be sent to the fixing device 6.

(g) Fixing device 6

The fixing device 6 serves to fix the toner images transferred to the transfer material P from the intermediate transfer body 3 at the transfer station to the transfer material P and includes a fixing roller 6*a* for applying heat to the transfer material P, and a pressure roller 6*b* for urging the transfer material P against the fixing roller 6*a*. The rollers 6*a*, 6*b* are hollow rollers having heaters 6*a*1, 6*b* therein. While the transfer material P is being pinched between and conveyed by the fixing roller 6*a* and the pressure roller 6*b* , by applying heat and pressure to the transfer material, the toner images are fixed to the transfer material P.

The transfer material P left the fixing device 6 is passed through a sheet discharge path 25 and then is discharged onto a discharge portion 8 provided on the main body 1 of the image forming apparatus by means of discharge rollers 7.

Figure 3:
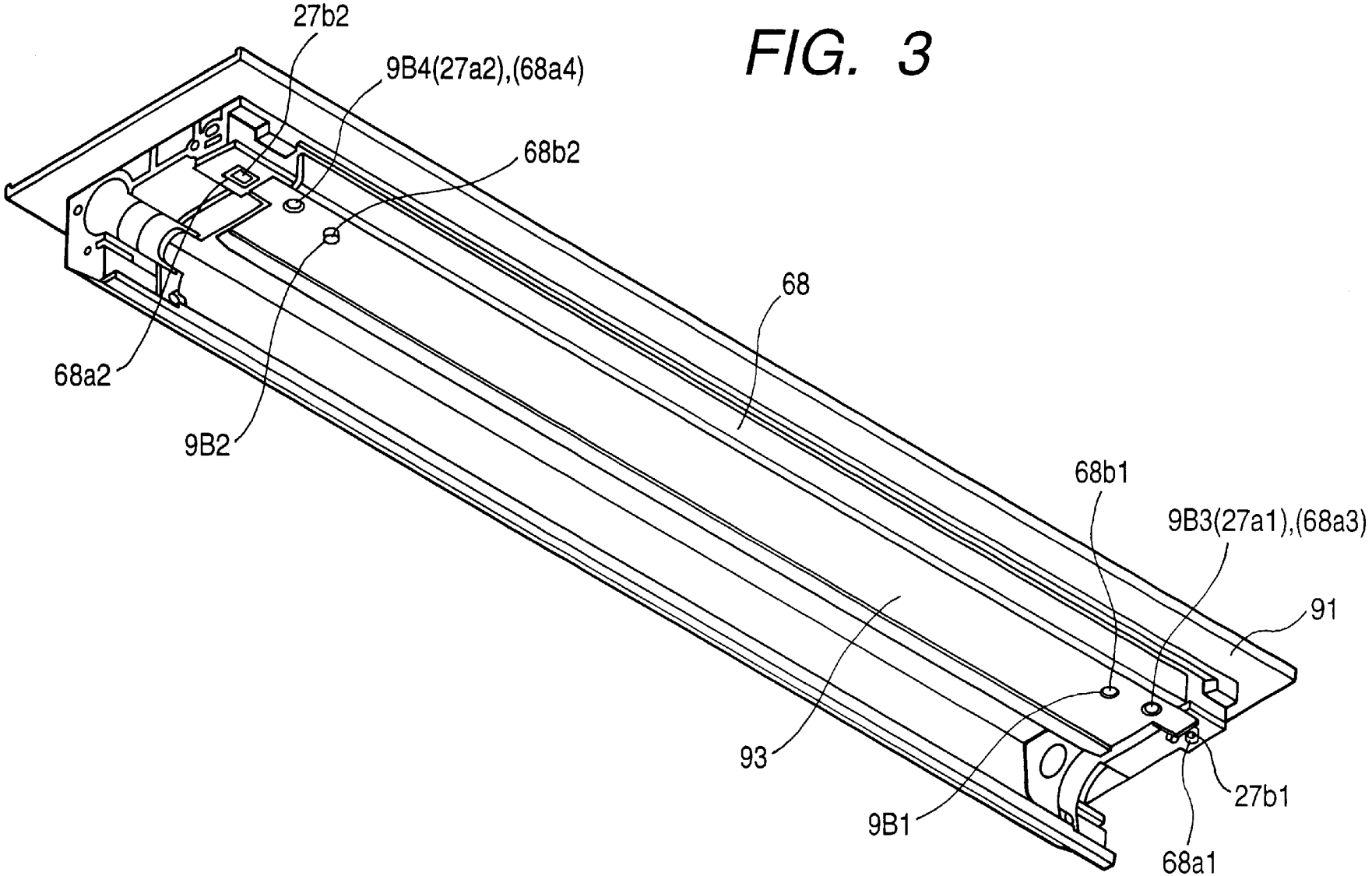
FIG. 3 is a perspective view showing an attachment relationship between an elastic regulating blade and an elastic regulating blade receiving member.
Figure 4:
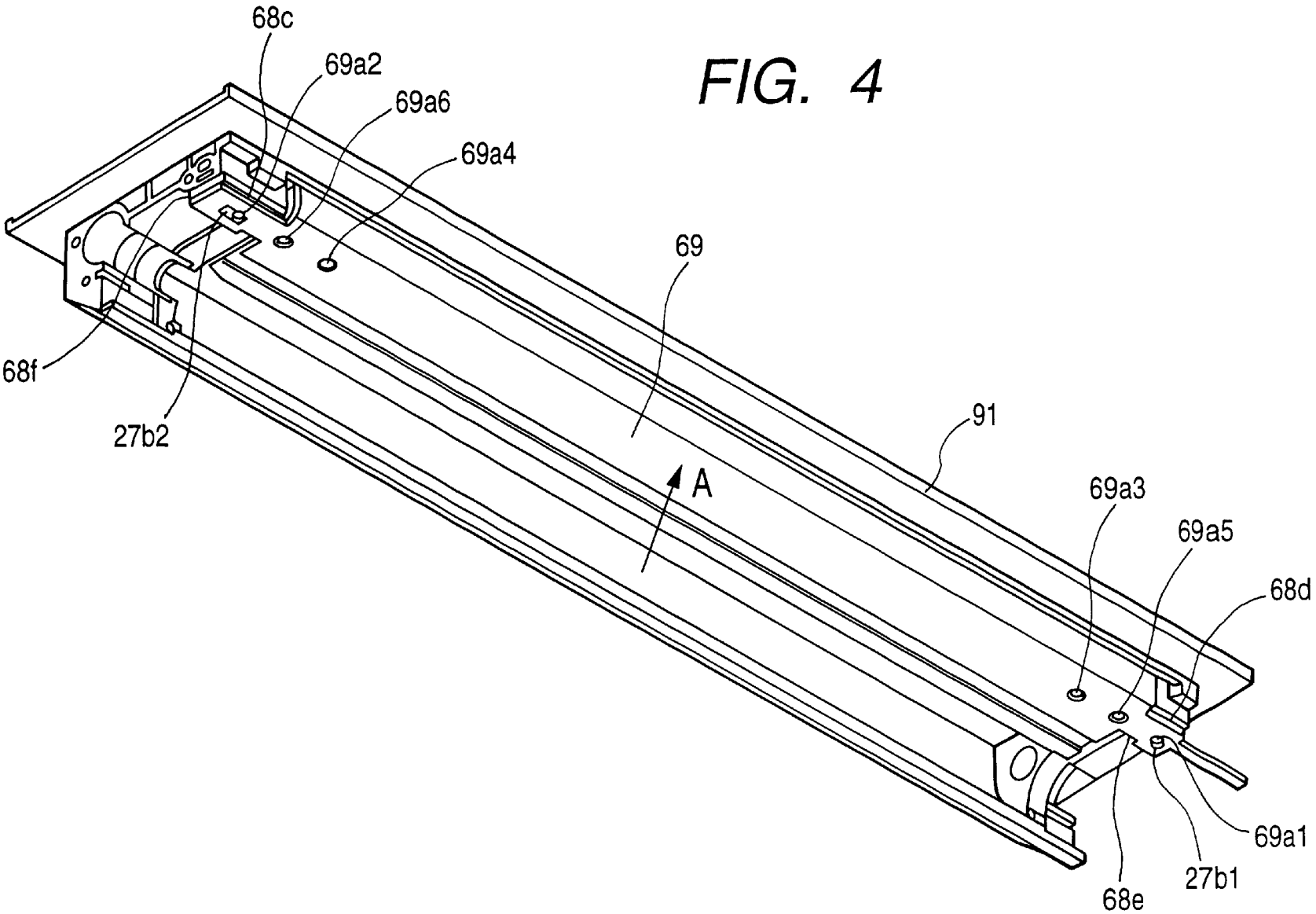
FIG. 4 is a perspective view showing an arrangement regarding attachment and adjustment of an elastic regulating blade, an elastic regulating blade receiving member and an elastic regulating blade hold-down metal plate.
Figure 5:
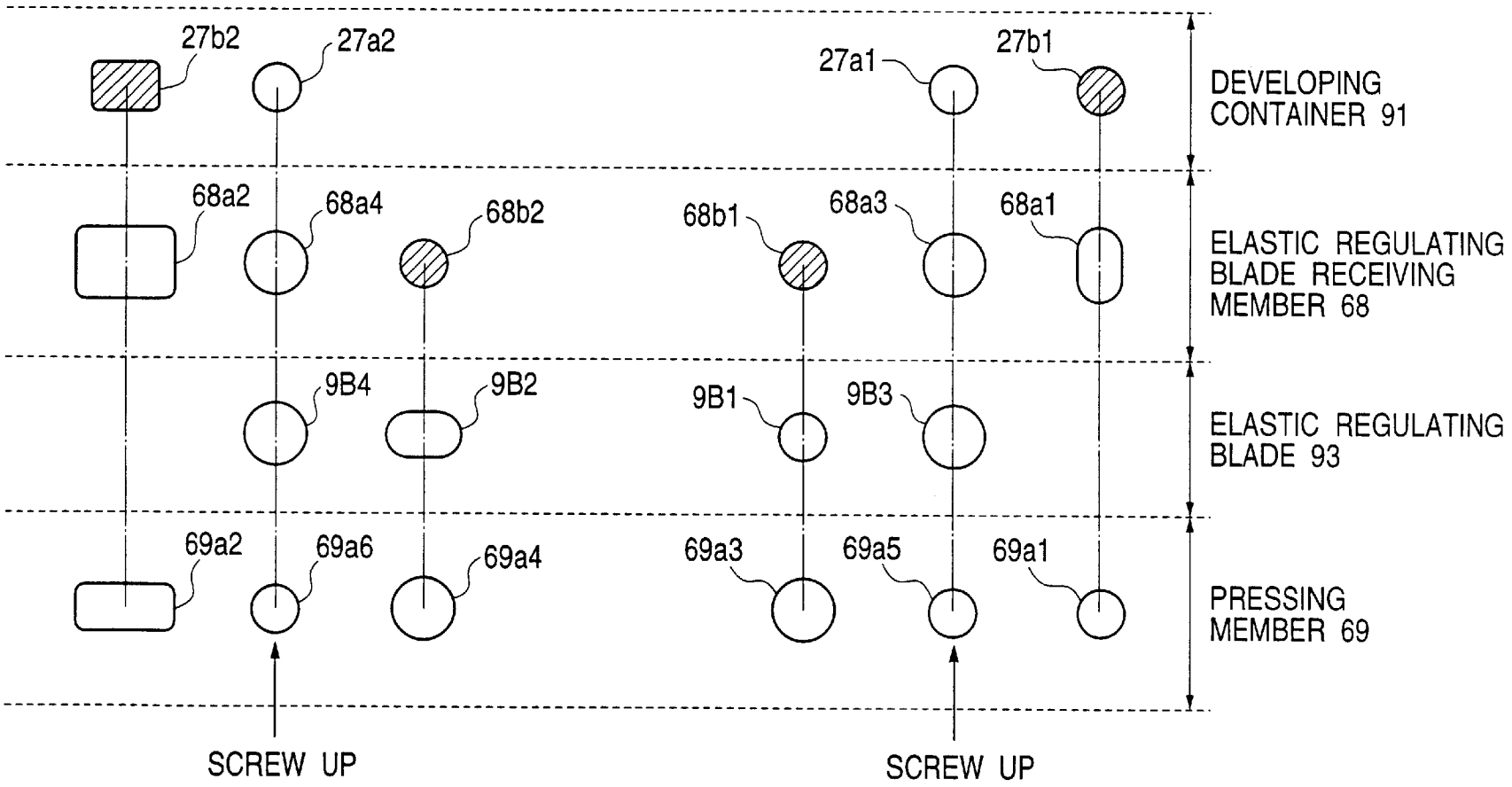
FIG. 5 is a view showing a relationship between positioning bosses and holes of various members.
Figure 6:
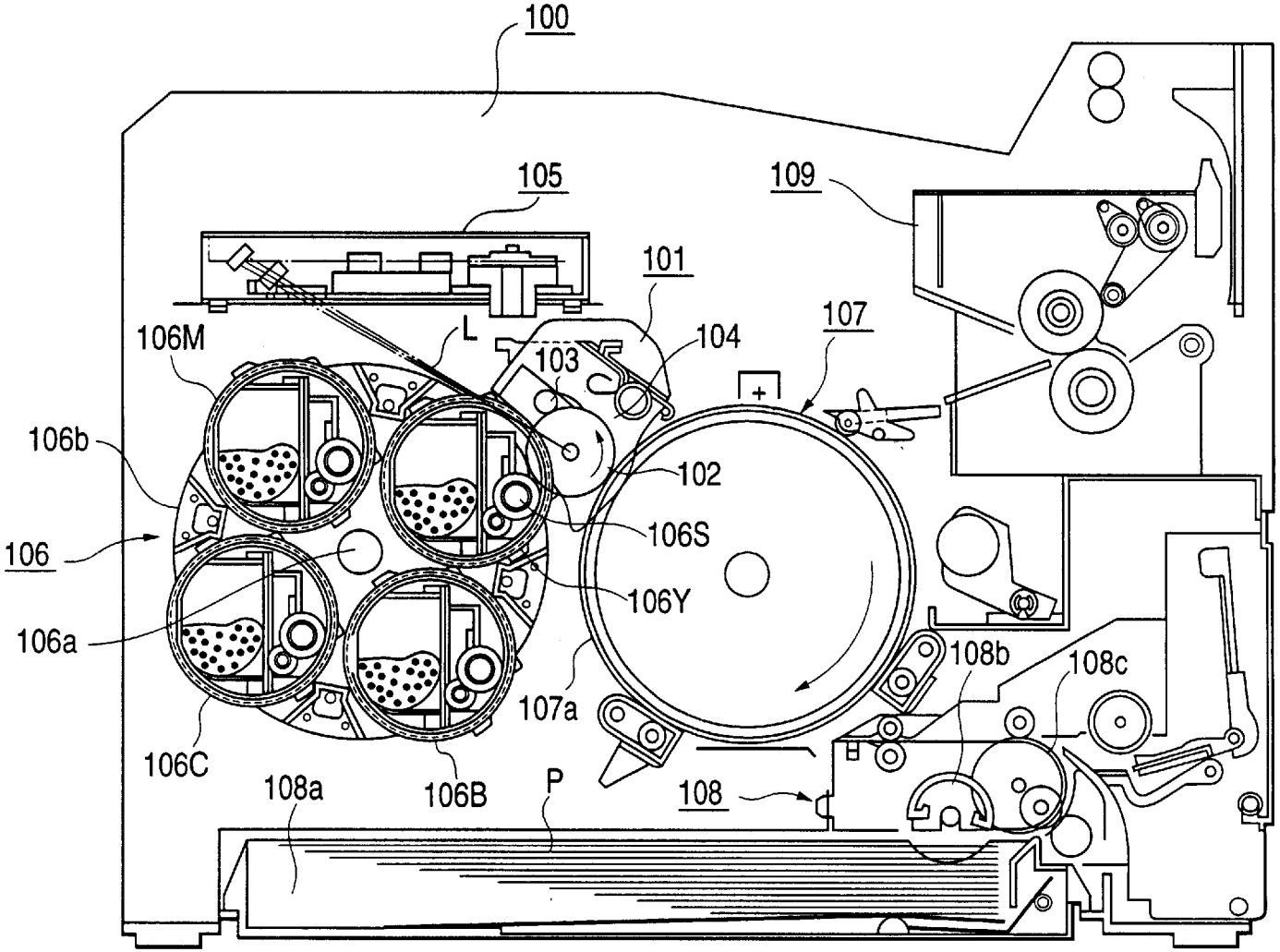
FIG. 6 is a schematic constructural view of a conventional image forming apparatus.
Figure 7:
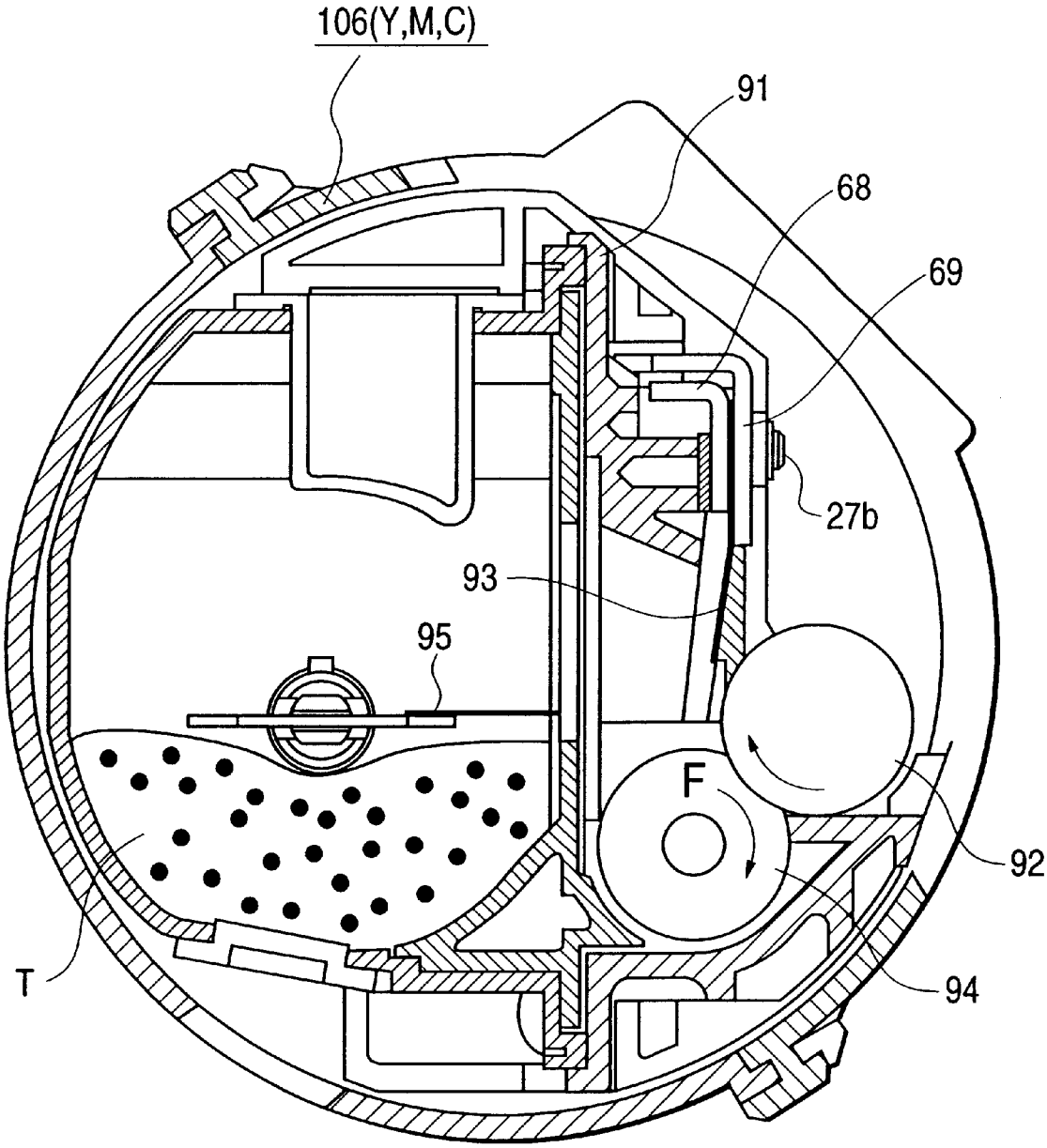
FIG. 7 is an enlarged view of a developing apparatus.

(2) Attachment structure for elastic regulating blade 93 of developing apparatus FIG. 3 is a perspective view showing an attachment relationship between the elastic regulating blade 93 and an elastic regulating blade receiving member. FIG. 4 is a perspective view showing a structure or arrangement for attaching and adjusting the elastic regulating blade 93, elastic regulating blade receiving member (metal plate) 68 as a positioning member, and an elastic regulating blade pressing member (metal plate) 69 and showing a condition that the pressing member 69 is rested on the receiving member 68 attached as shown in FIG. 3 and the elastic regulating blade 93. FIG. 5 is a view showing a relationship between positioning bosses and holes of the members 91, 68, 93 and 69.

In FIGS. 3 and 5, bosses 27*b*1, 27*b*2 for positioning the elastic regulating blade receiving member 68 are integrally formed on the developing container 91.

The receiving member 68 is provided with positioning holes 68*a*1, 68*a*2. The receiving member 68 is attached by engaging the hole 68*a*1 with the boss 27*b*1 and the hole 68*a*2 with the boss 27*b*2.

The hole 68*a*1 is an elongated hole having a width wise dimension greater than a diameter of the boss 27*b*1 by 1 mm or more, and the hole 68*a*2 is an elongated hole having widthwise and longitudinal dimensions greater than an outer diameter of the boss 27*b*2 by 1 mm or more. By fitting the hole 68*a*1 onto the boss 27*b*1 in the longitudinal direction, the receiving member 68 is positioned in the longitudinal direction.

The blade support metal plate for the elastic regulating blade 93 is provided with positioning holes 9B1, 9B2 which can be engaged with positioning bosses 68*b*1, 68*b*2 integrally formed on the receiving member 68.

The holes 9B1, 9B2 are fitted on the bosses 68*b*1, 68*b*2 in the widthwise direction, and the hole 9B1 is fitted in the boss 68*b*1 in the longitudinal direction, but the hole 9B2 is loosely received onto the boss 68*b*2 in the longitudinal direction (i.e., hole 9B2 is an elongated hole).

In FIGS. 4 and 5, the pressing member 69 is provided with positioning holes 69*a* 1, 69*a* 2 which can be engaged with positioning bosses 27*b*1, 27*b*2 integrally formed on the developing container 91.

The holes 69*a*1, 69*a*2 are fitted on the bosses 27*b*1, 27*b*2 in the widthwise direction, and the hole 69*a*1 is fitted in the boss 27*b*1 in the longitudinal direction, but the hole 69*a*2 is loosely received onto the boss 27*b*2 in the longitudinal direction (i.e., hole 69*a*2 is an elongated hole).

After the pressing member 69 is attached, screws are tightened into threaded holes 27*a1*, 27*a*2 of the developing container 91 through holes 69*a*5, 69*a*6. The screws also pass through holes 68*a*3, 68*a*4 formed in the receiving member 68 and holes 9B3, 9B4 formed in the elastic regulating blade 93.

When the elastic regulating blade 93 is adjusted, the tightened screws are slightly loosened without being completely removed to prevent floating of the pressing member 69, and then, the pressing member 69 is held by an adjusting tool from a direction shown by the arrow "A". In this condition, when edges 68*c*, 68*d*, 68*e*, 68*f*of the receiving member protruded outwardly from the pressing member 68 are pushed, since the receiving member 68 and the elastic regulating blade 93 are fitted in the widthwise direction, the elastic regulating blade 93 is shifted integrally with the receiving member 68.

Then, when the leading end of the elastic regulating blade 93 reaches a desired position, the screws are tightened again. In this way, the adjustment is completed.

Since the thickness of the receiving member 68 is greater than the thickness (about 0.1 mm to 0.2 mm) of the support metal plate for the elastic regulating blade 93 (by about 1 mm or more), during the adjustment, even when the receiving member is pushed, it is not deformed.

In the above embodiment, while an example that the developing cartridge is detachably attachable to the image forming apparatus was explained, a process cartridge having a developing apparatus and an electrophotographic photosensitive body (image bearing body) may be detachably attachable to the main body of the image forming apparatus. Further, in the present invention, the developing apparatus may be fixedly mounted on the main body of the image forming apparatus.

By providing an arrangement in which the elastic regulating blade is positioned with respect to the receiving member and the elastic regulating blade can be shifted integrally with the receiving member within the developing apparatus, after the elastic regulating blade is assembled to the developing container, when the receiving member is shifted, since the elastic regulating blade is also shifted, the position of the elastic regulating blade after assembling can be adjusted, and, thus, when accuracy of the adjusting tool is enhanced, accuracy for positional adjustment of the elastic regulating blade can easily be improved.

Therefore, without critical or severe accuracy of parts such as the elastic regulating blade, developing container and elastic regulating blade receiving member, accuracy of position of the elastic regulating blade within the developing apparatus can be improved.

What is claimed is:

1. A developing apparatus comprising:

a developing container for containing developer;

a developer bearing body provided at an opening portion of said developing container and adapted to bear and convey the developer to a developing position;

a regulating member adapted to regulate a thickness of a developer layer borne on said developer bearing body, said regulating member having an elastic blade portion contacted with the developer borne on said developer bearing body, and a support portion for supporting said elastic blade portion; and a positioning member for holding said support portion, a thickness of said positioning member being greater than a thickness of said support portion, said positioning member being adjustable, in a longitudinal direction of said regulating member, with respect to said developing container by shifting with said regulating member with respect to said developing container while holding said regulating member.

2. A developing apparatus according to claim 1, wherein the developer is a nonmagnetic one-component developer.

3. A developing apparatus according to claim 1, wherein said support portion and said positioning member have plate shapes.

4. A developing apparatus according to claim 1, wherein said positioning member has an engagement portion capable of being engaged with said developing container, and the position of said positioning member can be adjusted together with said support portion with respect to said developing container while engaging said engagement portion of said positioning member with said developing container.

5. A developing apparatus according to claim 1, wherein the thickness of said support portion is 0.1 mm to 0.2 mm.

6. A developing apparatus according to claim 1, wherein the developing apparatus is provided in a cartridge detachably attachable to a main body of an image forming apparatus.

7. A developing apparatus according to claim 6, wherein said cartridge has an image bearing member against which the developing apparatus effects development.

8. A developing apparatus according to claim 1, wherein the developing apparatus is provided in an image forming apparatus.

9. A developing apparatus according to claim 1, wherein said positioning member is adjustable, in a direction orthogonal to the longitudinal direction, with respect to said developing container.

10. A method for assembling a developing apparatus comprising the steps of:

providing a regulating member for regulating a thickness of a developer layer borne on a developer bearing body for bearing and conveying developer to a developing position, said regulating member having an elastic blade portion contacted with developer borne on said developer bearing body, and a support portion for supporting said elastic blade portion; and holding said support portion on a positioning member, a thickness of said positioning member being greater than a thickness of said support portion;

wherein said positioning member is adjustable, in a longitudinal direction of said regulating member, with respect to said developing container by shifting with said regulating member with respect to said developing container while holding said regulating member.

11. A method according to claim 10, wherein the developer is a nonmagnetic one-component developer.

12. A method according to claim 10, wherein said support portion and said positioning member have plate shapes.

13. A method according to claim 10, wherein said positioning member has an engagement portion capable of being engaged with said developing container, and the position of said positioning member can be adjusted together with said support portion with respect to said developing container while engaging said engagement portion of said positioning member with said developing container.

14. A method according to claim 10, wherein the thickness of said support portion is 0.1 mm to 0.2 mm.

15. A method according to claim 10, wherein said developing apparatus is provided in a cartridge detachably attachable to a main body of an image forming apparatus.

16. A method according to claim 15, wherein said cartridge has an image bearing member against which said developing apparatus effects development.

17. A method according to claim 10, wherein the developing apparatus is provided in an image forming apparatus.

18. A developing apparatus comprising:

a developer container for containing developer;

a developer bearing body provided at an opening portion of said developing container and adapted to bear and convey the developer to a developing position;

a regulating member adapted to regulate a thickness of a developer layer borne on said developer bearing body, said regulating member having an elastic blade portion contacted with the developer borne on said developer bearing body, and a support portion for supporting said elastic blade portion; and a positioning member for holding said support portion, a thickness of said positioning member being greater than a thickness of said support portion, said positioning member being adjustable with respect to said developing container by shifting with said regulating member with respect to said developing container while holding said regulating member; and a pressing member for pressing said support portion, wherein said support portion is pinched between said pressing member and said positioning member.

19. A developing apparatus according to claim 18, wherein said support portion, said positioning member and said pressing member have plate shapes.

20. A method for assembling a developing apparatus comprising the steps of:

providing a regulating member for regulating a thickness of a developer layer borne on a developer bearing body for bearing and conveying developer to a developing position, said regulating member having an elastic blade portion contacted with the developer borne on said developer bearing body, and a support portion for supporting said elastic blade portion; and holding said support portion on a positioning member, a thickness of said positioning member being greater than a thickness of said support portion;

wherein said positioning member can be adjusted with respect to said developing container by shifting with said regulating member with respect to said developing container while holding said regulating member; and wherein said developing apparatus comprises a pressing member for pressing said support portion, and said support portion is pinched between said pressing member and said positioning member.

21. A method according to claim 20, wherein said developing apparatus comprises a pressing member for pressing said support portion, and said support portion is pinched between said pressing member and said positioning member.

22. A method according to claim 11, wherein said positioning member is adjustable, in a direction orthogonal to the longitudinal direction, with respect to said developing container.

* * * * *

UNITED STATES PATENT AND TRADEMARK OFFICE

CERTIFICATE OF CORRECTION

PATENT NO. : 6,298,203 B1
DATED : October 2, 2001
INVENTOR(S) : Kouji Hashimoto et al.

It is certified that error appears in the above-identified patent and that said Letters Patent is hereby corrected as shown below:

Title page,
References Cited, "20-122415 4/2000 (JP)" should read -- 2-12245 4/1990 (JP) --.

Column 1,
Line 59, "an" should read -- a --.

Column 3,
Line 50, "92 effectively." should read -- 92. --.

Column 6,
Line 14, "can" should read -- can be --.

Column 7,
Line 24, "in" (second occurrence) should be deleted.

Column 8,
Line 61, "apparatus FIG. 3" should read -- apparatus ¶FIG. 3 --.

Column 9,
Line 51, "68*f*of" should read -- 68*f* of --.

Signed and Sealed this

Thirtieth Day of April, 2002

*Attest:*

*Attesting Officer*

JAMES E. ROGAN
*Director of the United States Patent and Trademark Office*